United States Patent [19]

Klumpp

[11] 4,418,608

[45] Dec. 6, 1983

[54] ARRANGEMENT FOR PRE-SELECTING THE CADENCE OF FIRING BURSTS OF A PRESSURIZED GAS LOADER OF A GUN

[75] Inventor: Walter Klumpp, Duisburg, Fed. Rep. of Germany

[73] Assignee: Rheinmetall GmbH, Duesseldorf, Fed. Rep. of Germany

[21] Appl. No.: 244,019

[22] Filed: Mar. 16, 1981

[30] Foreign Application Priority Data

Mar. 22, 1980 [DE] Fed. Rep. of Germany ..... 3011172

[51] Int. Cl.[3] ..... F41D 5/08

[52] U.S. Cl. ..... 89/193

[58] Field of Search ..... 89/191 R, 191 A, 193

[56] References Cited

U.S. PATENT DOCUMENTS

| | | | |
|---|---|---|---|
| 2,340,293 | 2/1944 | Balleisen | 89/193 |
| 2,382,411 | 8/1945 | Green | 89/193 |
| 2,494,889 | 1/1950 | Maillard | 89/191 |
| 3,988,964 | 11/1976 | Moore | 89/193 |
| 4,273,025 | 6/1981 | Bremer et al. | 89/193 |

FOREIGN PATENT DOCUMENTS

| | | | |
|---|---|---|---|
| 1128112 | 9/1968 | United Kingdom | 89/193 |

*Primary Examiner*—Charles T. Jordan
*Assistant Examiner*—Maureen T. Ryan

[57] ABSTRACT

In an automatic gas-driven firing weapon such as a machine cannon, an improved arrangement for pre-selecting the cadence of firing bursts. The weapon includes at least one first conduit in the gun barrel for conducting at least a portion of the gases formed at firing to an outlet of this first conduit. The housing of the weapon has a second and one or more third conduits for respectively conducting gases to the ammunition feed drive and the breech block drive. A ring body is rotatably mounted on the housing and is disposed between the first conduit, on the one hand, and the second and third conduits, on the other hand. The ring body has a plurality of passages of different cross-sections which can be positioned by rotating the ring body so as to provide a communication passage of pre-selected cross-section between the first conduit and the second and third conduits.

10 Claims, 2 Drawing Figures

ARRANGEMENT FOR PRE-SELECTING THE CADENCE OF FIRING BURSTS OF A PRESSURIZED GAS LOADER OF A GUN

BACKGROUND OF THE INVENTION

The invention relates to an arrangement for pre-selecting the cadence of a gas pressure loader of a machine cannon, which is a further development of U.S. Pat. No. 4,273,025 where the same weapon is described in the following words: "Gas-Loading Automatic Weapon I.G.A. Machine Gun". There is already known an arrangement wherein there is branched off via a separate branch the required portion of the propulsion gas which forms during the firing, which is used for driving the gas loader. This portion of the gas is taken out of a nozzle pipe with predetermined cross-section, which nozzle pipe can be exchanged for a nozzle pipe of a different cross-section. For each respective cross-section of the nozzle pipe there corresponds a predetermined cadence range, so that by means of a pre-selected nozzle exchange the transfer from one to the other cadence range is effected. Such an exchange of nozzle pipes is time consuming, and also the machine cannon is not operable or ready to be fired during the time it takes to exchange the nozzles.

SUMMARY OF THE INVENTION

The object of this invention is to provide a mechanical arrangement for pre-selecting a predetermined cadence which can be incorporated into and/or removed from the weapon without the aforedescribed drawbacks and in which the transfer from one cadence range to the other is made possible by means of a simple and secure adjustment in the shortest possible time period. Furthermore, the firing bursts which are of extended duration, particularly the unintentional prolongation of the firing burst during malfunctioning, which could lead to an unintentional firing of the corresponding stored ammuniton, is avoided. The aforedescribed object is achieved by means of an arrangement briefly described above wherein, between a power gas lead-in in the gun barrel and a conduit which extends through the wall of the weapon housing towards a gas piston of the ammunition feed drive mechanism, a ring body is rotatably mounted around the gun barrel and around the housing axis and this ring body is also fixable on the housing. The conduit is arranged on a circular arc which intersects with its middle axis and along which openings of different cross-sections are disposed. A selected one of these openings connects, in the firing position, the respective outlet end of the power lead-in with the inlet end of the conduit to the gas piston. Thereby it is possible, by means of simply turning the ring body to adjust the arrangement for different firing cadences. In accordance with the invention there is furthermore provided that the ring body, in at least one position, interrupts the connection between the outlet end of the power lead-in and the inlet end of the conduit, which position is the zero position. It is therefore also possible by means of a simple rotation of the ring body to interrupt each firing burst for a short time.

Thereby there is achieved by means of the invention a particularly simple mechanical arrangement which, as compared with the electronic arrangements of the state of the art, dispenses with the required searching for malfunctions and thus makes them unnecessary. In addition thereto, by adjusting the zero position, the corresponding gas conduit is immediately interrupted, so that the weapon can be made inoperative by means of a simple manual adjustment and its damage can be avoided.

In accordance with the invention the arrangement for the drives can be constructed to include a plurality of functions. This is achieved by means of a conduit in the weapon housing leading to the gas piston for the belt drive mechanism and one, but preferably two conduits for the gas pistons of the breech mechanism are provided and these conduits respectively correspond to the coacting power lead-in gas conduits in the gun barrel and openings of different cross sections in the ring body. Because of constructional reasons it is recommended that two conduits for the breech mechanism are provided, since the blocking slider would otherwise be driven unilaterally and thereby could be tilted.

In order to avoid pressure surges between the gun barrel, in which during firing a pressure of about 3600 bar can build up and the conduit for the gas piston, in which a pressure of about 500 bar can prevail, the openings in the ring body are preferably formed as a nozzle type extending from the housing to the gun barrel in an upward inclined direction. In order to laterally seal off the inlet opening in the ring nozzle as well as to push the ring nozzle againt the weapon housing there can, in accordance with the invention, be provided a threaded insert in a threaded recess of the gun barrel for each power lead-in conduit and each gas piston, in the form of a through-bore sealing piston, which laterally seals off, with its flat or preferably dome-shaped piston surface, the inlet opening for the conduit in the ring body. In order to maintain the ring nozzle in the respective selected position, there can be provided an arresting lever which can be selectively actuated and can be pivotally mounted in one or the other gun barrel wall. The arresting lever is under a spring pressure and is arranged in a recess corresponding to either the zero positions or to the openings of the ring body. For the simple adjustment to each position there can be provided a handle mounted outside of the weapon proper, whose actuating element is connected with the ring body, for example with an eye thereof. In order to achieve an automatic termination of the firing burst, the actuating element can be formed by a piston-rod arranged in a cylinder, for example the handle, and can conduct to the inner chamber of the cylinder a certain amount of gas at each firing in such a way that after a predetermined number of firings the piston in the cylinder pushes the ring body into the zero position. In order to ensure that, even after firing several thousand shots, the ensuing wear at the ring openings do not cause the ring body to become inoperable, this ring body can be constructed in such a way, that the openings, respectively nozzles are disposed in the lower region, whereas in the upper region a corresponding further arrangement of openings, respectively nozzles is provided, which after swinging the ring body about 180 degrees can be brought into operative communication with the power lead-in conduits.

It has been found advantageous because of constructional reasons to provide the conduits for the belt feed mechanism on the vertical or horizontal middle lines of the weapon housing, whereas the conduit for the breech are displaced 35 degrees from the horizontal middle line.

BRIEF DESCRIPTION OF THE DRAWINGS

The above and other objects, features and advantages of the present invention will become more readily apparent from the following description, reference is being made to the accompanying drawings, in which.

DETAILED DESCRIPTION

Figure 1:
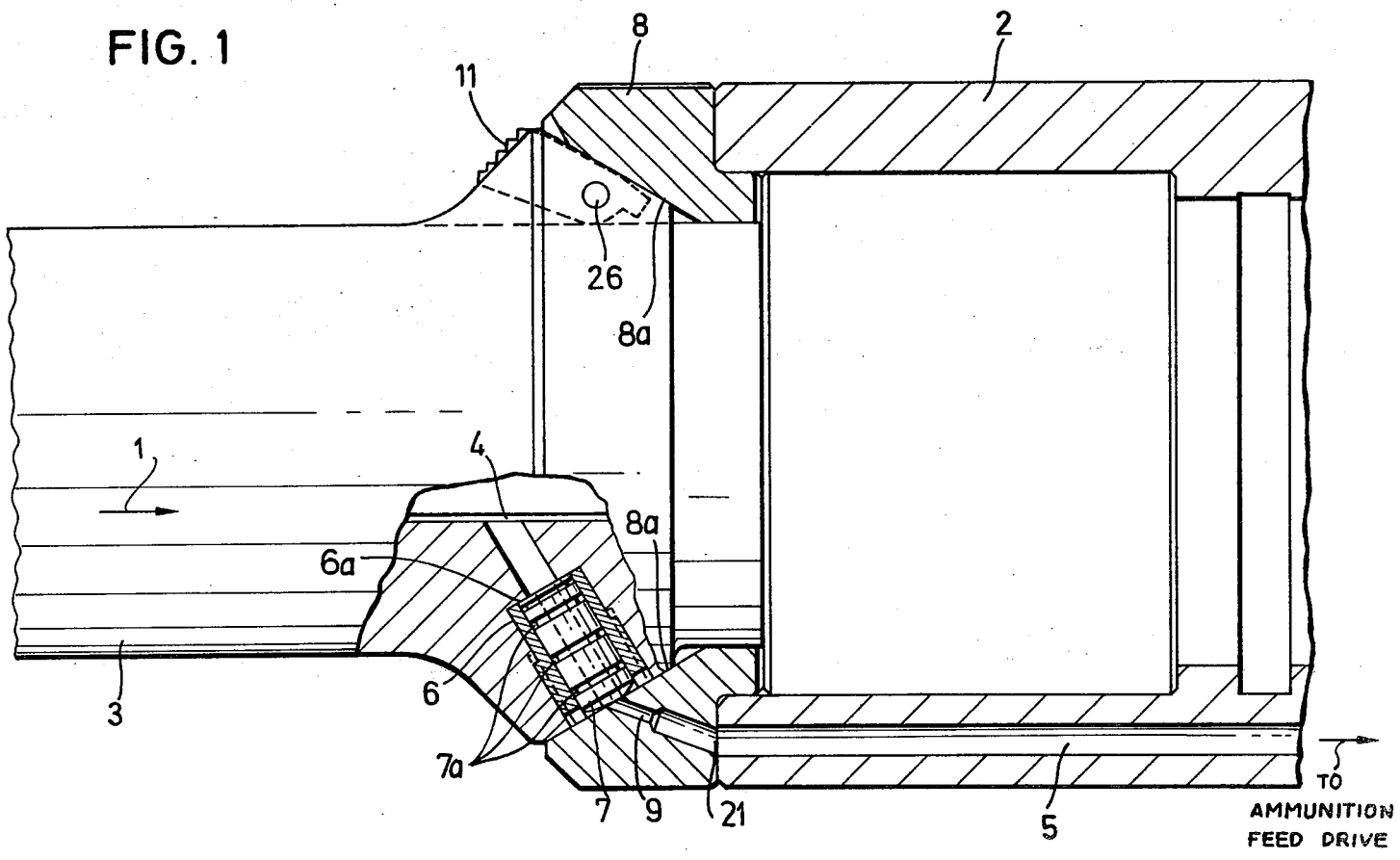
FIG. 1 is a horizontal sectional view of the arrangement.
Figure 2:
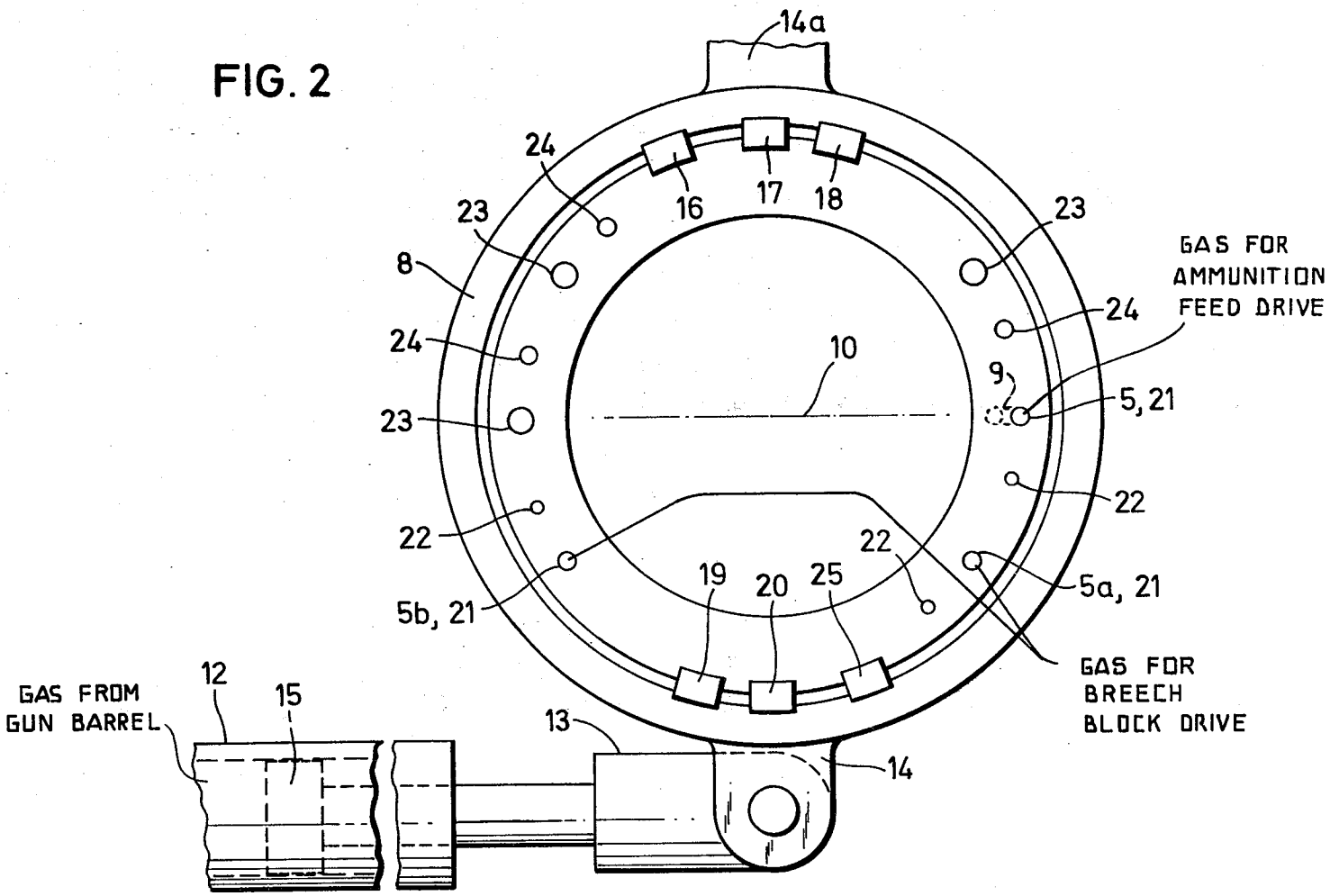
FIG. 2 is a side view of the ring body 8.

In FIG. 1 there is illustrated the direction of gas travel by means of the arrow 1, the weapon housing 2 and the gun barrel 3. The gas conduit 4 is in communication via the nozzle conduit 9 with the conduit 5 for the gas piston. A threaded insert piece 6 is mounted in the threaded blind bore 6*a* of the power lead-in conduit, wherein the piston 7 is slidably mounted which abuts with the flat or convex front surface against the opening of the generally radially outwardly inclined nozzle conduit 9. The piston 7 is slidably mounted by means of piston rings 7*a* which are slidably disposed on the blind bore 6*a* and sealingly engages with its forward end face the edges of the conduit 9. The ring body 8 has a plurality of openings 21 and a plurality of recesses 16, 17, 18 (FIG. 2) in which an arresting lever 11, pivotally mounted on the weapon housing by means of a pivot pin 26, can engage. In FIG. 1 there is only illustrated a convex end face of the piston 7. Such a convex end face is required since the ring body 8 has a round inner surface 8*a* and only a convex end face can sealingly engage the outer edges of the nozzle conduit 9. There is illustrated in FIG. 2 the ring body 8 having the openings 21, which, in the firing position are disposed respectively in front of the inlet openings of the conduit 5, 5*a* and 5*b*. By rotating the ring body 8 towards the left the openings 22 can be brought in position so that they are confronting the inlet openings of the conduits 5, 5*a* and 5*b*. These openings have a smaller cross section and thereby effect a smaller cadence. The recesses 17 and 18 correspond to both firing positions, whereas the zero position corresponds with the recess 16. After rotating the ring body 8 about 180°, after approximately 1,000 shots, whereas under normal operation only a rotation should result between recesses 16 to 18, the openings 23, 24 now are positioned in the place of the openings 21, 22 and the recesses 19, 20 and 25 are now in the position of the recesses 17, 18 and 16. An eye 14 of the ring body 8 is connected to the actuating element 13. This actuating element extends with its free end in the form of a piston 15 into a cylinder 12 which is in the form of a handle. After rotating the ring body about 180° the eye 14*a* is now positioned in the place of the eye 14 and is then pivotally connected to the actuating element 13.

If the end face of the piston 7 is flat the inner surface 8*a* of ring body 8 must be machined so as to present a flat surface which can be sealingly engaged by a flat surface of the end face of piston 7. Nevertheless, the ring body 8 can be rotated in view of the play between piston 7 and ring body 8.

The arrangement preferably includes three similar angularly spaced gas pistons 7 and three correspondingly angularly spaced nozzle conduits 9 which respectively coact with the conduits 5, 5*a* and 5*b*. The conduits 5*a* and 5*b* are respectively angularly displaced 35° from the horizontal line 10 in FIG. 2.

For simplicity of illustration, only the gas piston 7 (FIG. 1) which cooperates with gas conduit 5 is shown.

Although the invention is illustrated and described with reference to one preferred embodiment thereof, it is to be expressly understood that it is in no way limited to the disclosure of such a preferred embodiment, but is capable of numerous modifications within the scope of the appended claims.

I claim:

1. In an arrangement for preselecting the cadence of firing bursts in a machine cannon having a pressurized gas loader operatively mounted in the housing of the machine cannon, said arrangement including means for conducting a portion of the gases formed during firing to the driving means of the weapon, said conducting means having a passage and being provided with means to adjust the cross-section thereof to thereby preselect the cadence of the firing burst, the improvement comprising in combination, said conducting means including at least one first conduit disposed in the walls of the gun barrel and at least one second conduit disposed in the housing of the weapon and in operative communication with the gas loader thereof;

a ring body operatively mounted on said housing coaxially with respect to said gun barrel and housing and between said first and second conduits;

said ring body having a plurality of passages disposed therein of different cross-sections, the outlet ends of said passages being disposed along a circular arc in said ring body which intersects the axis of said second conduit means;

a selected one of said passages forming a conduit for the gases formed at firing from the outlet of the first conduit to the inlet of the second conduit to conduct said gases to a driving piston of the gas loader of the weapon.

2. The improvement of the arrangement for preselecting the cadence of firing bursts in a weapon, as set forth in claim 1, wherein said ring body interrupts in at least one position the passage of gas from the outlet of the first conduit to the inlet of the second conduit, said one position corresponding to the zero position.

3. The improvement of the arrangement for preselecting the cadence of firing bursts in a weapon, as set forth in claim 2, including three second conduits, one of which is in operative communication with the ammunition feed drive and the other two are in operative communication with the breech block drive, said passages in said ring body providing conduits of preselected cross-sections between said first conduit and said second conduits.

4. The improvement of the arrangement for preselecting the cadence of firing bursts in a weapon, as set forth in claim 3, wherein said passages in said ring body are formed as nozzle pipes which are inclined radially outwardly from the weapon housing to the gun barrel.

5. The improvement of the arrangement for preselecting the cadence of firing bursts in a weapon, as set forth in claim 4, including a threaded bore in said first conduit, a cylindrical insert threadably mounted in said bore, a sealing piston having a flat or convex sealing surface is operatively mounted in said cylindrical insert, said sealing piston being adapted to selectively seal said second conduit with its sealing surface.

6. The improvement of the arrangement for preselecting the cadence of firing bursts in a weapon, as set forth in claim 5, wherein said ring body includes a first recess corresponding to the zero position and second and third recesses corresponding to the first and second operative positions and a spring-loaded arresting lever pivotally mounted in said weapon housing and being biased to extend into one of said recesses.

7. The improvement of the arrangement for preselecting the cadence of firing bursts in a weapon, as set forth in claim 6, including a handle pivotally connected to said ring body.

8. The improvement of the arrangement for preselecting the cadence of firing bursts in a weapon, as set forth in claim 7, wherein said handle is formed as a cylinder, piston and piston rod, said piston rod being pivotally connected to said ring body, and means for conducting a predetermined amount of gas during firing to said cylinder, so that after a predetermined number of shots have been fired, the piston moves the ring body to the zero position.

9. The improvement of the arrangement for preselecting the cadence of firing bursts in a weapon, as set forth in claim 8, wherein said plurality of passages in said ring body are divided into two identical groups which are diametrically opposite from each other so that one or the other group can be brought into their operative position by rotating the ring body 180° about its axis.

10. The improvement of the arrangement for preselecting the cadence of firing bursts in a weapon, as set forth in claim 9, wherein said one second conduit which is in operative communication with the ammunition feed drive is disposed on a horizontal or vertical diameter line of housing, whereas the other two conduits which are in operative communication with the breech block are angularly spaced 35° from the horizontal diameter line.

* * * * *